US006136710A

United States Patent [19]

Quek et al.

[11] Patent Number: 6,136,710

[45] Date of Patent: Oct. 24, 2000

[54] CHEMICAL MECHANICAL POLISHING APPARATUS WITH IMPROVED SUBSTRATE CARRIER HEAD AND METHOD OF USE

[75] Inventors: Ser Wee Sebastian Quek; Charles Lin; Jimmy Lo(Yuk Ting), all of Singapore, Singapore

[73] Assignee: Chartered Semiconductor Manufacturing, Ltd., Singapore, Singapore

[21] Appl. No.: 09/174,659

[22] Filed: Oct. 19, 1998

[51] Int. Cl.[7] ..... H01L 21/302

[52] U.S. Cl. ..... 438/691; 438/692

[58] Field of Search ..... 438/691, 692, 438/693; 451/5, 44, 41, 289, 288, 287, 388, 398; 156/345

[56] References Cited

U.S. PATENT DOCUMENTS

| | | | |
|---|---|---|---|
| 5,403,228 | 4/1995 | Pasch | 451/259 |
| 5,571,044 | 11/1996 | Bolandi et al. | 451/385 |
| 5,614,446 | 3/1997 | Ramaswami et al. | 437/228 |
| 5,624,299 | 4/1997 | Shendon | 451/28 |
| 5,643,061 | 7/1997 | Jackson et al. | 451/289 |
| 5,681,215 | 10/1997 | Sherwood et al. | 451/388 |
| 5,695,392 | 12/1997 | Kim | 451/288 |
| 5,916,015 | 6/1999 | Natalicio | 451/288 |
| 5,944,590 | 8/1999 | Isobe et al. | 451/288 |
| 5,957,751 | 9/1999 | Govzman et al. | 451/8 |
| 5,993,302 | 11/1999 | Chen et al. | 451/285 |
| 6,004,193 | 12/1999 | Nagahara et al. | 451/285 |

*Primary Examiner*—Benjamin L. Utech
*Assistant Examiner*—Duy-Vu Deo
*Attorney, Agent, or Firm*—George O. Saile; Rosemary L.S. Pike

[57] ABSTRACT

An improved and new substrate carrier head for use in a CMP apparatus is described. The new substrate carrier head has a substrate retaining ring with embedded intersecting channels in the outer face. The embedded intersecting channels improve the circulation of polishing slurry to and from the polished substrate and polishing byproducts away from the polished substrate and thereby improve the polishing uniformity on the substrate.

14 Claims, 5 Drawing Sheets

CHEMICAL MECHANICAL POLISHING APPARATUS WITH IMPROVED SUBSTRATE CARRIER HEAD AND METHOD OF USE

BACKGROUND OF THE INVENTION (1) Field of the Invention

This invention relates to an apparatus and method for CMP (Chemical Mechanical Polishing) of a semiconductor substrate and more specifically to an improved substrate carrier head for a CMP apparatus, having a substrate retaining ring that facilitates distribution of the polishing slurry onto the substrate, thus improving the polish removal rate uniformity.

(2) Description of Related Art

In the fabrication of semiconductor integrated circuits CMP (Chemical Mechanical Polishing) has been developed for providing smooth topographies on surfaces deposited on the semiconductor substrates. Rough topography results when metal conductor lines are formed over a substrate containing device circuitry. The metal conductor lines serve to interconnect discrete devices, and thus form integrated circuits. The metal conductor lines are further insulated from the next interconnection level by thin layers of insulating material and holes formed through the insulating layers provide electrical access between successive conductive interconnection layers. In such wiring processes, it is desirable that the insulating layers have a smooth surface topography, since it is difficult to lithographically image and pattern layers applied to rough surfaces. CMP can, also, be used to remove different layers of material from the surface of a semiconductor substrate. For example, following via hole formation in an insulating material layer, a metallization layer is blanket deposited and then CMP is used to produce planar metal studs embedded in the insulating material layer.

Briefly, the CMP processes involve holding and rotating a thin, flat substrate of the semiconductor material against a wetted polishing surface under controlled chemical, pressure and temperature conditions. A chemical slurry containing a polishing agent, such as alumina or silica, is used as the abrasive material. Additionally, the chemical slurry contains selected chemicals which etch various surfaces of the substrate during processing. The combination of mechanical and chemical removal of material during polishing results in superior planarization of the polished surface.

In CMP apparatuses the substrate being polished is affixed to a planar carrier head. The carrier head and affixed substrate are then pressed against the polishing pad having the polishing slurry thereon. In order to secure the substrate to the carrier head during polishing a retaining ring surrounds the substrate. The retaining ring surrounding the substrate has an inner diameter slightly larger than the diameter of the substrate. The outer diameter cf the retaining ring is approximately 1 inch larger than the inner diameter, thus forming a 1 inch wall in the retaining ring. The thickness of the retaining ring is about ⅞ inch and the upper and lower surfaces of the retaining ring are parallel. The retaining ring, as described, prevents the substrate from slipping from the polishing head during polishing, but has the detrimental effect of impeding the flow of polishing slurry to and from the substrate during polishing. It is known in the art that polishing uniformity is a function of pressure, velocity, and concentration of polishing chemicals. Furthermore, as a substrate is polished chemical byproducts locally change the uniformity of the polishing slurry through changing the slurry pH, slurry composition, and slurry particle size and these local changes can affect the local polish removal rate.

Since an important challenge in CMP is to improve the uniformity of the polish removal rate across the substrate, it is, therefore important to control the distribution of polishing slurry over the substrate during the polishing process and to control the removal of polishing byproducts from the substrate during the polishing process in order to achieve maximum polish removal uniformity. At the same time it is important to maximize the throughput of CMP machines in order to reduce the cost of product. However, state-of-the-art retaining rings for CMP apparatus impede the flow of slurry to and from the substrate during polishing and, also, impede the removal of polishing byproducts from the substrate during polishing.

U.S. Pat. No. 5,681,215 entitled "Carrier Head Design For a Chemical Mechanical Polishing Apparatus" granted Oct. 28, 1997 to Michael T. Sherwood et al describes a CMP carrier head having a retaining ring in the base assembly. The retaining ring includes a protruding portion which contacts the polishing pad and blocks the substrate from slipping out from under the base assembly. Also, described is a polishing station that includes a separate pad conditioning apparatus having a rotatable arm and an independently rotating conditioner head. The conditioner apparatus maintains the condition of the polishing pad so that it will effectively polish any substrate pressed against it while it is rotating.

U.S. Pat. No. 5,624,299 entitled "Chemical Mechanical Polishing Apparatus With Improved Carrier and Method of Use" granted Apr. 29, 1997 to Norman Shendon shows a (MP carrier head which facilitates substrate loading, retaining and unloading in a CMP apparatus.

U.S. Pat. No. 5,571,044 entitled "Wafer Holder For Semiconductor Wafer Polishing Machine" granted Nov. 5, 1996 to Hooman Bolandi et al describes a wafer holder for a polishing machine.

U.S. Pat. No. 5,643,061 entitled "Pneumatic Polishing Head For CMP Apparatus" granted Jul. 1, 1997 to Paul David Jackson et al describes a CMP polishing head which includes a retaining ring. The wafer substrate can be pressed against the polishing pad with a force independent of the force applied to the retaining ring. Spiral grooves, included in the underside of the retaining ring, assist in circulating the polishing slurry about a wafer substrate within the retaining ring.

U.S. Pat. No. 5,614,446 entitled "Holding Apparatus, A Metal Deposition System, and a Wafer Processing Method Which Preserve Topographical Marks on a Semiconductor Wafer" granted Mar. 25, 1997 to Seshadri Ramaswami et al describes a wafer retaining ring which prevents metal deposition on a portion of a wafer substrate.

U.S. Pat. No. 5,403,228 entitled "Techniques For Assembling Polishing Pads For Silicon Wafer Polishing" granted Apr. 4, 1995 to Nicholas R. Pasch describes the mounting of laminated polishing pads to a polishing platen. The mounting method prevents catastrophic delamination of the pads and, also, forms a bowl-like surface which retains slurry better than a planar surface.

The present invention is directed to a novel CMP apparatus and CMP method which improve the distribution of polishing slurry onto the substrate and improve the polish removal rate uniformity on the substrate.

SUMMARY OF THE INVENTION

It is a general object of the present invention to provide an improved and new apparatus and CMP (Chemical Mechanical Polishing) method in which improved polish removal uniformity is achieved.

Another object of the present invention is to provide a new and improved apparatus and CMP method whereby polishing slurry is uniformly distributed onto the substrate being polished.

A further object of the present invention is to provide a new and improved apparatus and CMP method whereby polishing byproducts are uniformly carried away from the substrate being polished.

And yet another object of the present invention is to provide a retaining ring in a CMP apparatus which improves the circulation of polishing slurry to and from the polished substrate and polishing byproducts away from the polished substrate.

In accordance with the present invention, the above and other objectives are realized by a carrier head for chemical mechanical polishing, comprising: an assembly connectable to a drive shaft to rotate with said drive shaft; a base to hold a substrate against a polishing pad; and a retaining ring surrounding said base to hold said substrate beneath said base, said retaining ring having embedded in its outer surface an array of intersecting channels for the purpose of flowing polishing slurry to and away from the edge of the substrate and polished byproducts away from the edge of the substrate.

The above and other objectives are realized by using a method of CMP comprising the steps of: providing a polishing pad affixed to a rotatable polishing platen; providing a rotatable carrier head to hold a substrate against said polishing pad; providing a retaining ring surrounding said rotatable carrier head to hold said substrate beneath said rotatable carrier, said retaining ring having embedded in its outer surface an array of intersecting channels for the purpose of flowing polishing slurry to and away from the edge of the substrate and polished byproducts away from the edge of the substrate; providing a means for holding said rotatable carrier head and said retaining ring in juxtaposition relative to said polishing pad affixed to said rotatable polishing platen with an applied pressure between the rotatable carrier head and the rotatable polishing platen; dispensing a polishing slurry onto said rotatable polishing pad; providing a first means to rotate said carrier head and said retaining ring; and providing a second means to rotate said polishing platen.

BRIEF DESCRIPTION OF THE DRAWINGS

The object and other advantages of this invention are best described in the preferred embodiments with reference to the attached drawings that include.

DESCRIPTION OF THE PREFERRED EMBODIMENTS

The new and improved CMP apparatus having an improved substrate retaining ring which improves the circulation of polishing slurry to and from the polished substrate and polishing byproducts away from the polished substrate, and its method of use will now be described in detail.

Figure 1A:
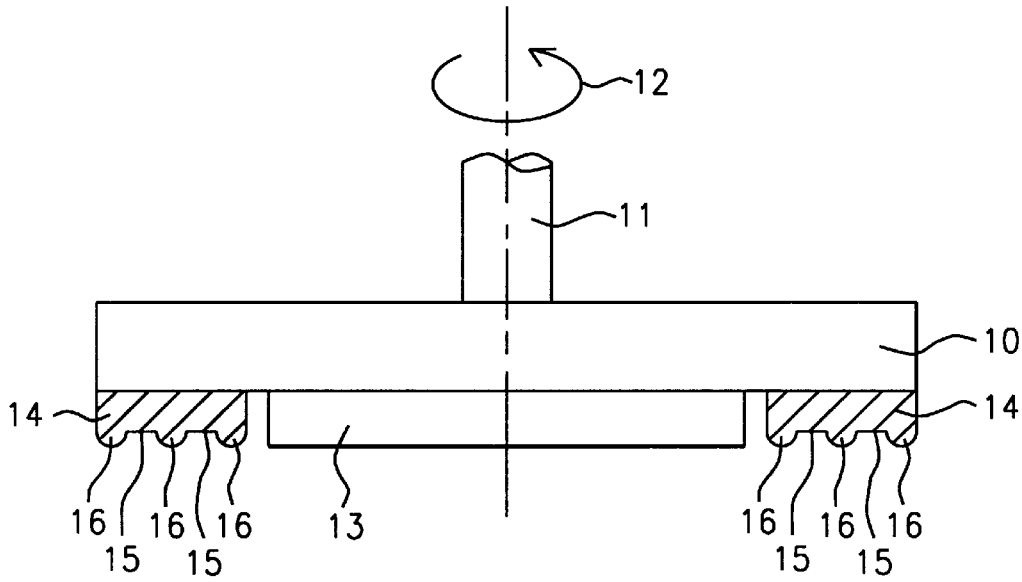
FIG. 1A, which in cross-sectional representation illustrates a CMP carrier head for one embodiment of the present invention.
Figure 1B:
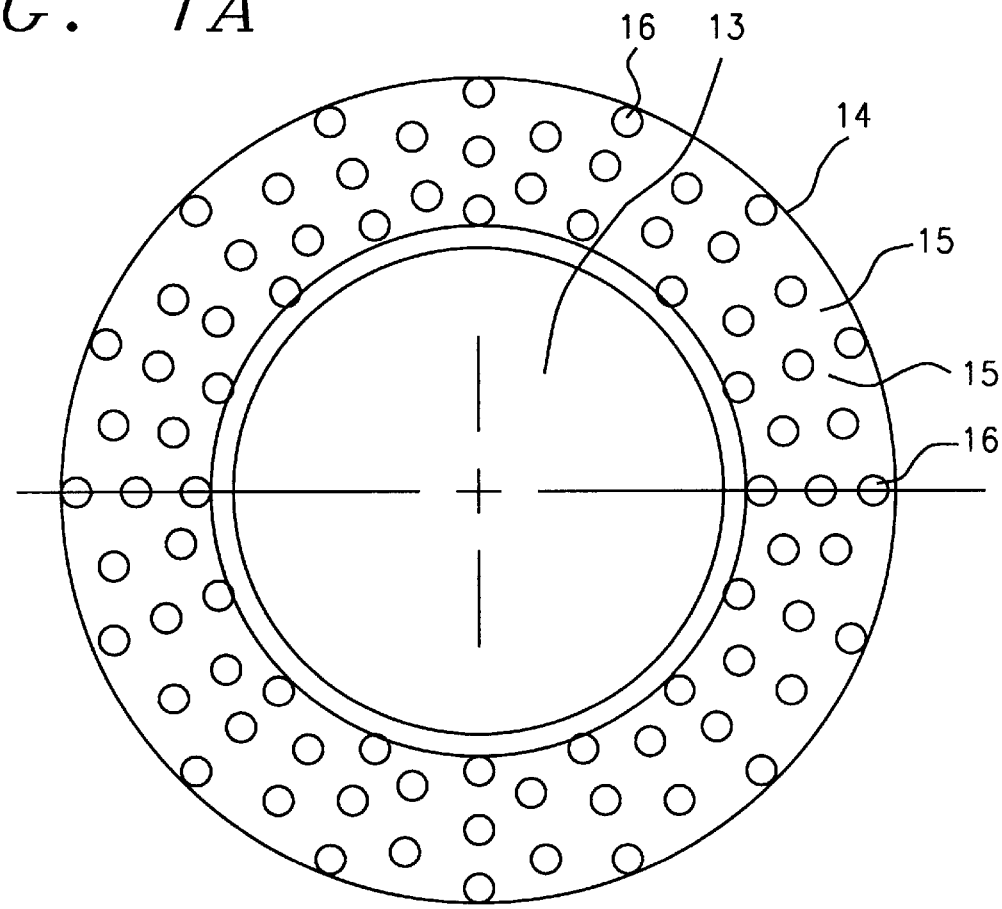
FIG. 1B, which is a bottom view of the carrier head illustrated in FIG. 1A.

Referring to FIG. 1A, which in cross-sectional representation illustrates a CMP carrier head, a base plate 10 is connected to a drive shaft 11, which is rotatable as indicated by arrow 12. The base plate 10 holds semiconductor substrate 13 against a polishing pad (not shown). Retaining ring 14 holds the semiconductor substrate 13 beneath the base plate 10. Retaining ring 14, illustrated with exaggerated width, has an inner diameter slightly larger than the diameter of the substrate. The outer diameter of the retaining ring is approximately 1 inch larger than the inner diameter, thus forming a 1 inch wall in the retaining ring. The thickness of the retaining ring 14 is about ⅞ inch. Formed on the underside of retaining ring 14 are channels 15 which facilitate the flow of polishing slurry to and from the substrate and polishing byproducts away from the edge of the substrate during polishing. The channels 15 are formed so that they are interlocking, thus providing multiple paths for slurry flow. The multiplicity and interlocking nature of channels 15 are further illustrated in FIG. 1B, which is a bottom view of the carrier head illustrated in FIG. 1A. Formed on the underside of retaining ring 14 is an array of hemispherical-like protrusions 16. The diameter of the hemispherical-like protrusions is between about ⅛ and ⅕ inch and the outer edges of the hemispherical-like protrusions are separated by a distance between about 1/10 and ⅛ inch. It is important that the multiplicity of hemispherical-like protrusions be uniformly distributed on the underside of the retaining ring. As illustrated in FIGS. 1A and 1B, the shape of protrusions 16 is hemispherical, however alternate hemispherical-like shapes may be formed. Typically semiconductor substrate 13 has a diameter between about 150 and 300 mm. However, substrates with diameter larger than 300 mm may, also, be polished.

Figure 2A:
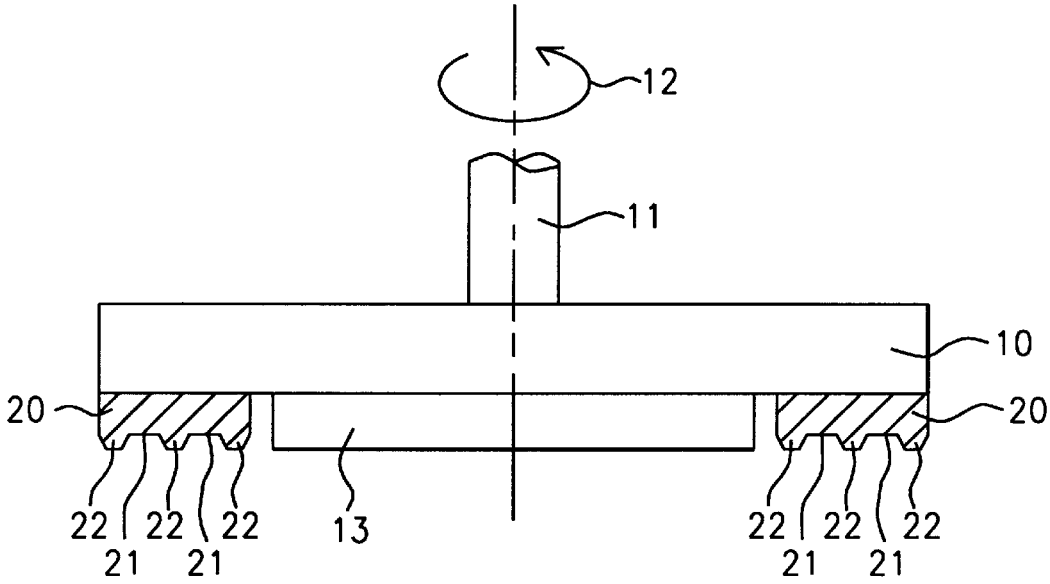
FIG. 2A, which in cross-sectional representation illustrates a CMP carrier head for a second embodiment of the present invention.
Figure 2B:
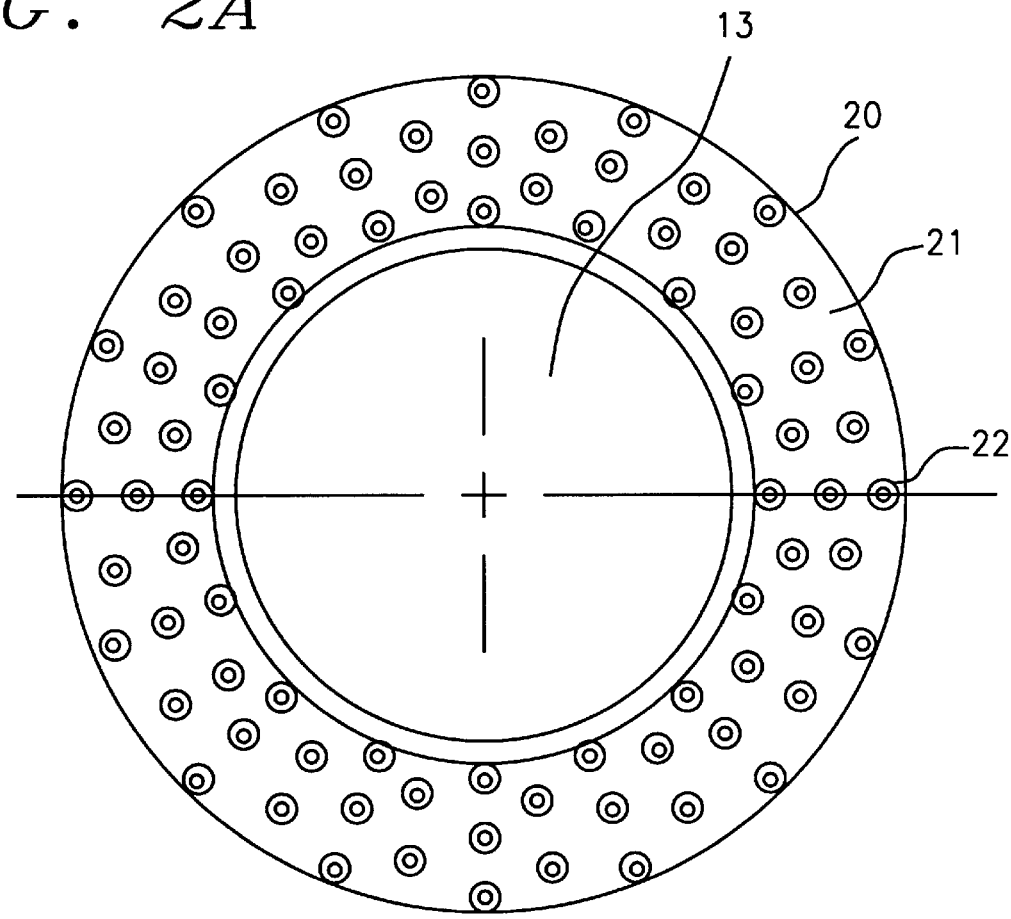
FIG. 2B, which is a bottom view of the carrier head illustrated in FIG. 2A.

Now referring to FIGS. 2A and 2B, a second embodiment of the present invention is illustrated. In FIG. 2A, which in cross-sectional representation illustrates a CMP carrier head, a base plate 10 is connected to a drive shaft 11, which is rotatable as indicated by arrow 12. The base plate 10 holds semiconductor substrate 13 against a polishing pad (not shown). Retaining ring 20 surrounds the semiconductor substrate 13 and serves to hold the semiconductor substrate 13 in place. Typically semiconductor substrate 13 has a diameter between about 150 and 300 mm. However, substrates with diameter larger than 300 mm may, also, be polished. Retaining ring 20, illustrated with exaggerated width, has an inner diameter slightly larger than the diameter of the semiconductor substrate. The outer diameter of the retaining ring is approximately 1 inch larger than the inner diameter, thus forming a 1 inch wall in the retaining ring. The thickness of the retaining ring 20 is about ⅞ inch. Formed on the underside of retaining ring 20 is an array of protrusions 22, having the shape of conical frustums. The frustums are truncated cones having a diameter between about ⅛ and ⅕ inch and a height between about ⅛ and ¼ inch. The conical frustum protrusions 22 are separated by a distance between about 1/10 and ⅛ inch, and thus form an array of interlocking channels 21 on the underside of the retaining ring 20. The interlocking channels 21 on the underside of the retaining ring allow flow of polishing slurry to and from the substrate and polishing byproducts away from the edge of the substrate during polishing. It is important that the multiplicity of conical frustum protrusions 22 be uniformly distributed on the underside of the retaining ring. As illustrated in FIG. 2B, the conical frustum protrusions 22 are uniformly distributed over the underside of the retaining ring in a regular array pattern. Alternately, the conical frustum protrusions may be distributed in a random array pattern.

Figure 3A:
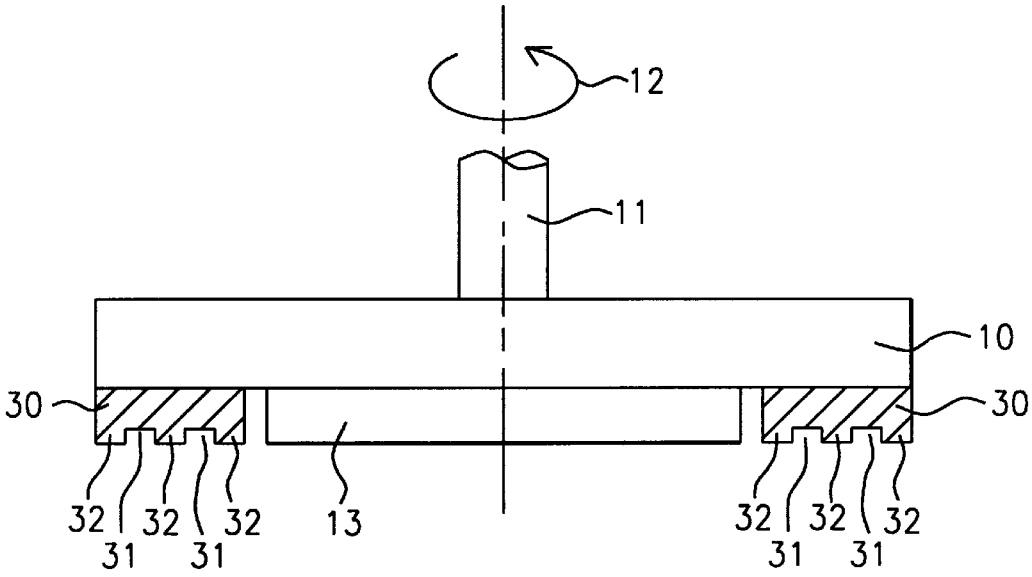
FIG. 3A, which in cross-sectional representation illustrates a CMP carrier head for a third embodiment of the present invention.
Figure 3B:
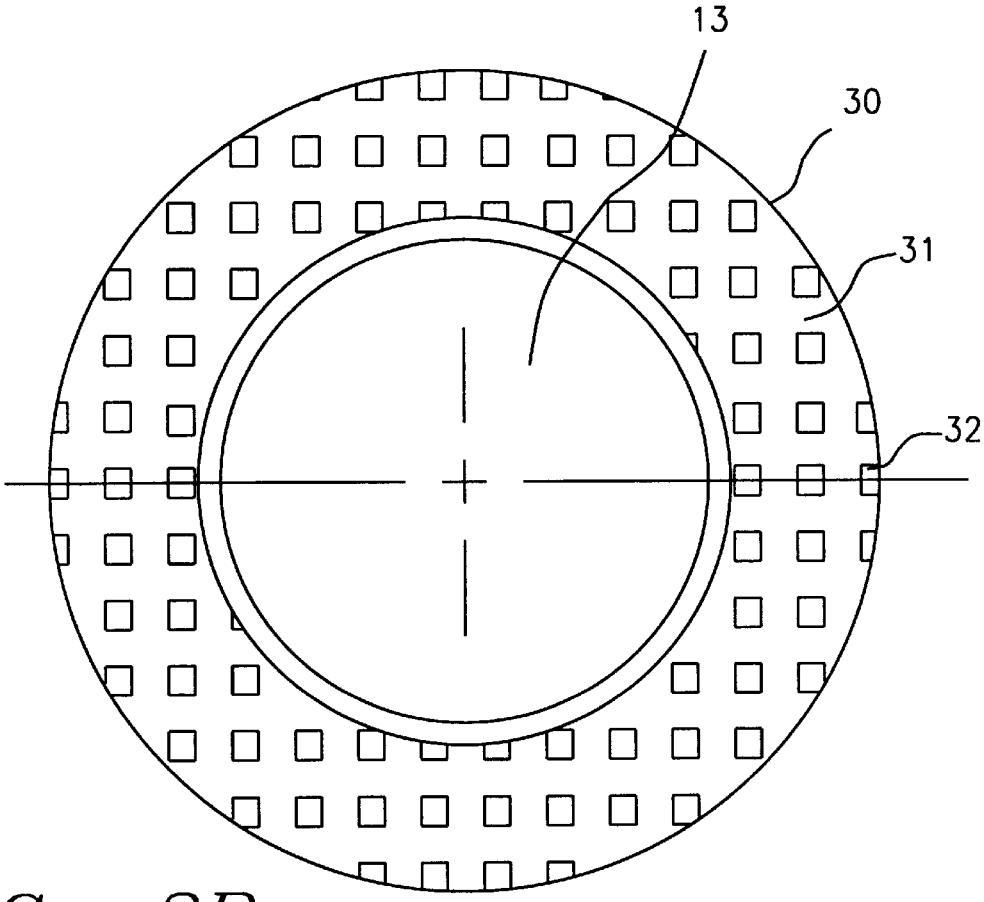
FIG. 3B, which is a bottom view of the carrier head illustrated in FIG. 3A.

Now referring to FIGS. 3A and 3B, a third embodiment of the present invention is illustrated. In FIG. 3A, which in cross-sectional representation illustrates a CMP carrier head, a base plate 10 is connected to a drive shaft 11, which is rotatable as indicated by arrow 12. The base plate 10 holds semiconductor substrate 13 against a polishing pad (not shown). Retaining ring 30 surrounds the semiconductor substrate 13 and serves to hold the semiconductor substrate 13 in place. Typically semiconductor substrate 13 has a diameter between about 150 and 300 mm. However, substrates with diameter larger than 300 mm may, also, be polished. Retaining ring 30, illustrated with exaggerated width, has an inner diameter slightly larger than the diameter of the semiconductor substrate. The outer diameter of the retaining ring is approximately 1 inch larger than the inner diameter, thus forming a 1 inch wall in the retaining ring. The thickness of the retaining ring 30 is about ⅞ inch. Formed on the underside of retaining ring 30 are channels 31 which facilitate the flow of polishing slurry to and from the substrate and polishing byproducts away from the edge of the substrate during polishing. The channels 31 are formed so that they are interlocking, thus providing multiple paths for slurry flow. The interlocking channels are formed from intersecting grooves, as shown in FIG. 3B, leaving an array of mesas 32 between the intersecting grooves. The channels 32 have a width between about 1/10 and ⅕ inch and a depth between about ⅛ and ¼ inch. The distance between channels 32 is between about 1/10 and ⅛ inch. It is important that the multiplicity of intersecting grooves be uniformly distributed on the underside of the retaining ring. As illustrated in FIG. 3B, the multiplicity of intersecting grooves is formed from orthogonally intersecting grooves, however other uniform groove distributions may be employed. The important feature is for the grooves to be intersecting in order to provide unrestricted flow of slurry to and from the substrate and polishing by byproducts away from the substrate during polishing.

Figure 4:
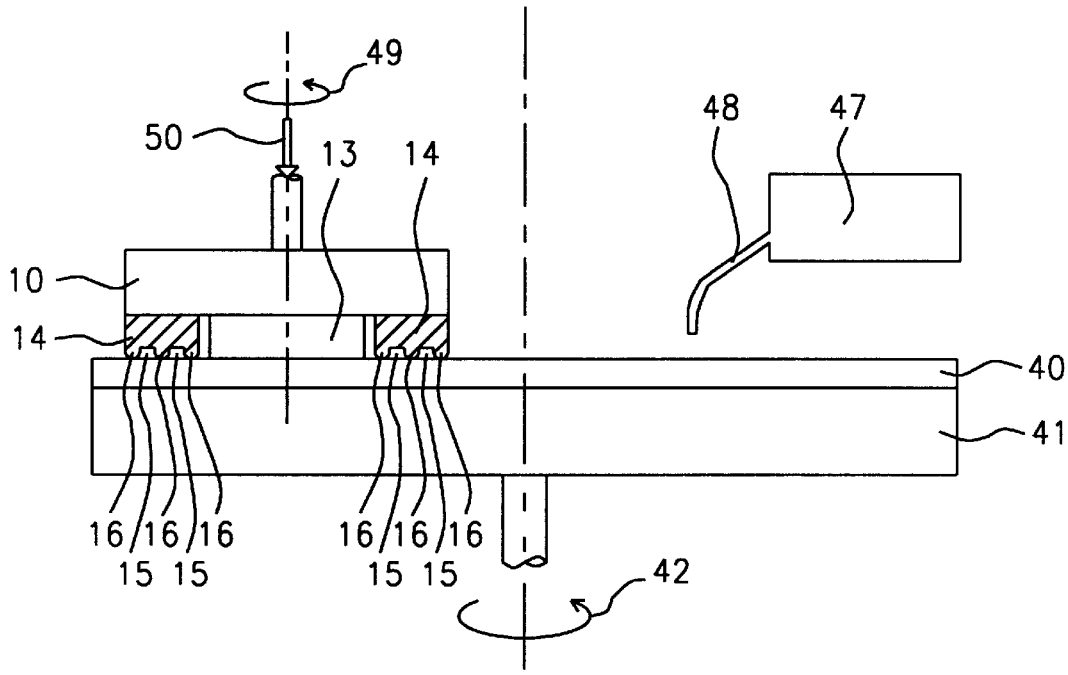
FIG. 4, which in cross-sectional representation illustrates a CMP apparatus which uses one embodiment of the CMP carrier head of the present invention FIG. 5, which in cross-sectional representation illustrates a CMP apparatus which uses a second embodiment of the CMP carrier head of the present invention.

The carrier heads described in FIGS. 1A and 1B, FIGS. 2A and 2B, and FIGS. 3A and 3B are used in a CMP apparatus to polish semiconductor substrates. For example, FIG. 4, in cross-sectional representation, illustrates the use of the carrier head shown in FIGS. 1A and 1B in a CMP apparatus. Polishing pad 40 is affixed to a rotatable polishing platen 41. A means is provided to rotate the polishing platen 41 and polishing pad 40, as shown by arrow 42. The rotatable carrier head 10 holds semiconductor substrate 13 against polishing pad 40. A retaining ring 14 holds semiconductor substrate 13 in place. The retaining ring 14 has a width between about ⅞ and 1 inch. Formed on the underside of retaining ring 14 is an array of hemispherical-like protrusions 16. The diameter of the hemispherical-like protrusions is between about ⅛ and ⅕ inch and the outer edges of the hemispherical-like protrusions are separated by a distance between about 1/10 and ⅛ inch. It is important that the multiplicity of hemispherical-like protrusions be uniformly distributed on the underside of the retaining ring. As illustrated in FIG. 4, the shape of protrusions 16 is hemispherical, however alternate hemi- spherical-like shapes may be formed. A polishing slurry comprising silica or alumina and polishing chemicals and $H_2O$ at a pH between about pH=3.5 and pH=11.5 is dispensed from reservoir 47 through conduit 48 onto polishing pad 40. Polishing platen 41 and polishing pad 40 are rotated at a speed between about 15 and 100 rpm. Carrier head 10 is rotated, as indicated by arrow 49, at a speed between about 15 and 100 rpm. The applied pressure, as indicated by arrow 50, between the rotatable carrier head 10 and the rotatable polishing platen 41 is between about 0.5 and 50 psi.

Figure 5:
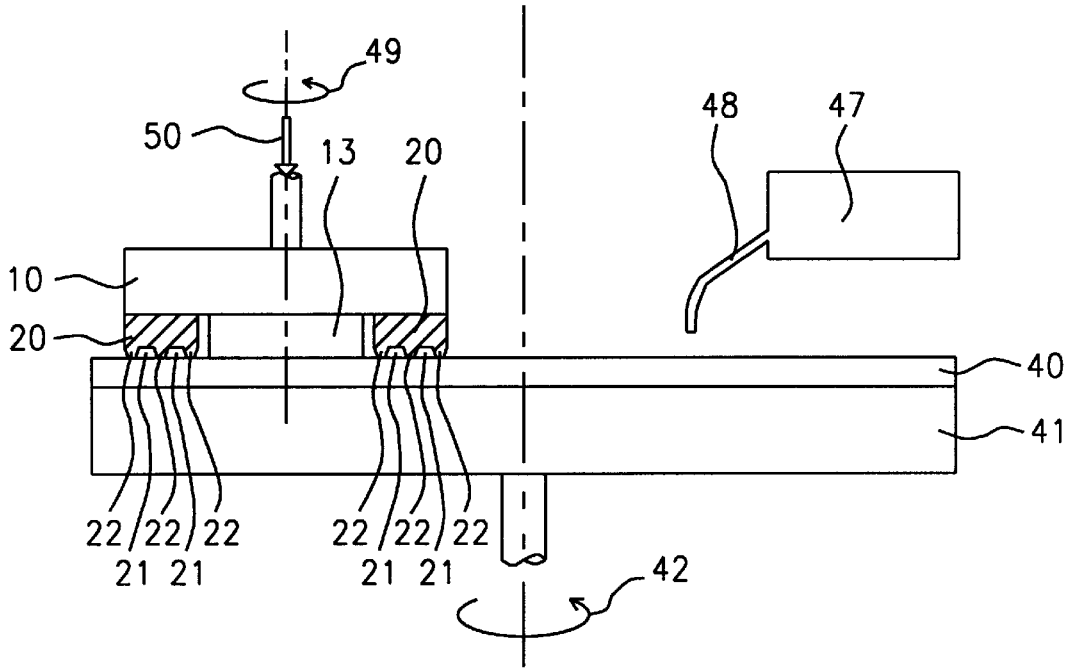

FIG. 5, in cross-sectional representation, illustrates the use of the carrier head shown in FIGS. 2A and 2B in a CMP apparatus. Polishing pad 40 is affixed to a rotatable polishing platen 41. A means is provided to rotate the polishing platen 41 and polishing pad 40, as shown by arrow 42. The rotatable carrier head 10 holds semiconductor substrate 13 against polishing pad 40. A retaining ring 20 holds semiconductor substrate 13 in place. The retaining ring 20 has a width between about ½ and 1 inch. Formed on the underside of retaining ring 20 is an array of protrusions 22, having the shape of conical frustums. The frustums are truncated cones having a diameter between about ⅛ and ⅕ inch and a height between about ⅛ and ¼ inch. The conical frustum protrusions 22 are separated by a distance between about 1/10 and ⅛ inch, and thus form an array of interlocking channels 21 on the underside of the retaining ring 20. It is important that the multiplicity of conical frustum protrusions 22 be uniformly distributed on the underside of the retaining ring. A polishing slurry comprising silica or alumina and polishing chemicals and $H_2O$ at a pH between about pH=3.5 and pH=11.5 is dispensed from reservoir 47 through conduit 48 onto polishing pad 40. Polishing platen 41 and polishing pad 40 are rotated at a speed between about 15 and 100 rpm. Carrier head 10 is rotated, as indicated by arrow 49, at a speed between about 15 and 100 rpm. The applied pressure, as indicated by arrow 50, between the rotatable carrier head 10 and the rotatable polishing platen 41 is between about 0.5 and 50 psi.

Figure 6:
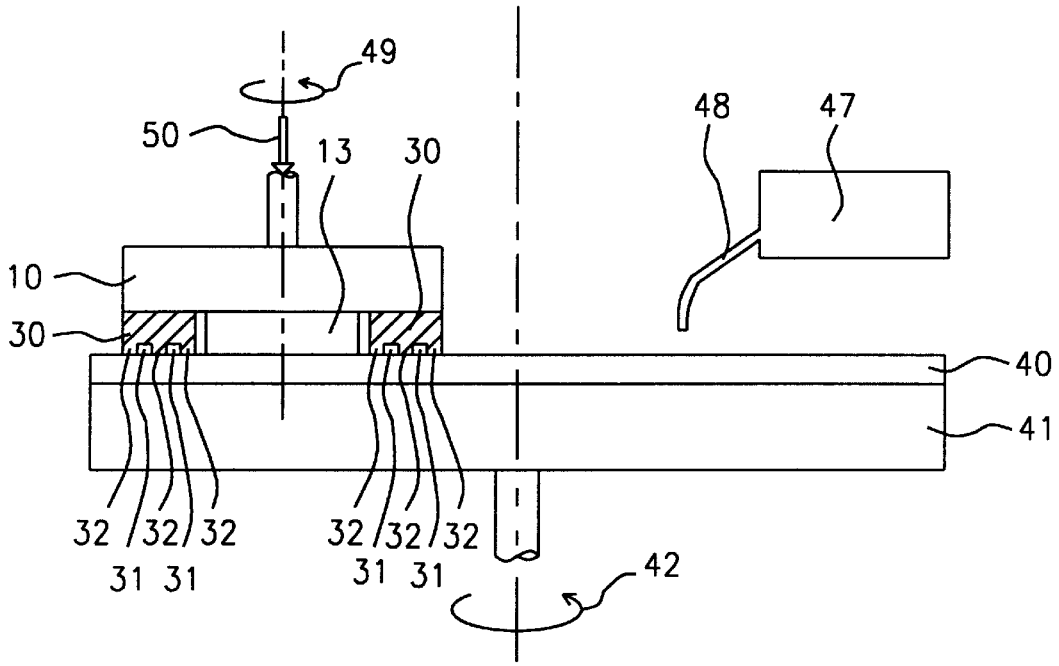
FIG. 6, which in cross-sectional representation illustrates a CMP apparatus which uses a third embodiment of the CMP carrier head of the present invention.

FIG. 6, in cross-sectional representation, illustrates the use of the carrier head shown in FIGS. 3A and 3B in a CMP apparatus. Polishing pad 40 is affixed to a rotatable polishing platen 41. A means is provided to rotate the polishing platen 41 and polishing pad 40, as shown by arrow 42. The rotatable carrier head 10 holds semiconductor substrate 13 against polishing pad 40. A retaining ring 30 holds semiconductor substrate 13 in place. The retaining ring 30 has a width between about ⅞ and 1 inch. Formed on the underside of retaining ring 30 are channels 31 which facilitate the flow of polishing slurry to and from the substrate during polishing. The channels 31 are formed so that they are interlocking, thus providing multiple paths for slurry flow. The channels 31 have a width between about 1/10 and ⅕ inch and a depth between about ⅛ and ¼ inch. The distance between channels 32 is between about 1/10 and ⅛ inch. It is important that the multiplicity of intersecting grooves be uniformly distributed on the underside of the retaining ring.

A polishing slurry comprising silica or alumina and polishing chemicals and $H_2O$ at a pH between about pH=3.5 and pH=11.5 is dispensed from reservoir 47 through conduit 48 onto polishing pad 40. Polishing platen 41 and polishing pad 40 are rotated at a speed between about 15 and 100 rpm. Carrier head 10 is rotated, as indicated by arrow 49, at a speed between about 15 and 100 rpm. The applied pressure, as indicated by arrow 50, between the rotatable carrier head 10 and the rotatable polishing platen 41 is between about 0.5 and 50 psi.

While the invention has been particularly shown and described with reference to the preferred embodiments thereof, it will be understood by those skilled in the art that various changes in form and details may be made without departing from the spirit and scope of the invention.

What is claimed is:

1. A CMP method comprising the steps of:

providing a polishing pad affixed to a rotatable polishing platen;

providing a rotatable carrier head to hold a substrate against said polishing pad;

providing a retaining ring surrounding said rotatable carrier head to hold said substrate beneath said rotatable carrier, said retaining ring having embedded in its outer surface an array of intersecting channels for the purpose of flowing polishing slurry to and away from the edge of the substrate and polished byproducts away from the edge of the substrate;

providing a means for holding said rotatable carrier head and said retaining ring in juxtaposition relative to said polishing pad affixed to said rotatable polishing platen with an applied pressure between the rotatable carrier head and the rotatable polishing platen;

dispensing a polishing slurry onto said rotatable polishing pad;

providing a first means to rotate said carrier head and said retaining ring; and providing a second means to rotate said polishing platen.

2. The method of claim 1, wherein said array of intersecting channels embedded in the outer surface of said retaining ring is formed by an array of hemispherical-like protrusions.

3. The method of claim 2, wherein said array of hemispherical-like protrusions has hemispherical-like protrusions having diameters between about ⅛ and ⅕ inch and the outer edges of the hemispherical-like protrusions are separated by a distance between about 1/10 and ⅛ inch.

4. The method of claim 2, wherein said array of hemispherical-like protrusions are uniformly distributed on the underside of said retaining ring.

5. The method of claim 1, wherein said array of intersecting channels embedded in the outer surface of said retaining ring is formed by an array of protrusions, having the shape of conical frustums.

6. The method of claim 5, wherein said array of intersecting channels embedded in the outer surface of said retaining ring is formed by an array of protrusions, having the shape of conical frustums having diameters between about ⅛ and ⅕ inch and heights between about ⅛ and ¼ inch.

7. The method of claim 5, wherein said array of protrusions, having the shape of conical frustums is uniformly distributed on the underside of said retaining ring.

8. The method of claim 1, wherein said array of intersecting channels embedded in the outer surface of said retaining ring is formed by an array of intersecting grooves.

9. The method of claim 8, wherein said intersecting channels have widths between about 1/10 and ⅕ inch and a depth between about ⅛ and ¼ inch and distances between channels between about 1/10 and ⅛ inch.

10. The method of claim 8, wherein said array of intersecting channels embedded in the outer surface of said retaining ring, formed by an array of intersecting grooves is uniformly distributed on the underside of said retaining ring.

11. The method of claim 1, wherein said polishing slurry comprises silica or alumina and polishing chemicals and $H_2O$ at a pH between about pH=3.5 and pH=11.5.

12. The method of claim 1, wherein said rotatable polishing platen is rotated at a speed between about 15 and 100 rpm.

13. The method of claim 1, wherein said rotatable carrier head is rotated at a speed between about 15 and 100 rpm.

14. The method of claim 1, wherein said applied pressure between the rotatable carrier head and the rotatable polishing platen is between about 0.5 and 50 psi.

* * * * *